US011291342B1

(12) United States Patent
Ebrahimi Afrouzi

(10) Patent No.: US 11,291,342 B1
(45) Date of Patent: Apr. 5, 2022

(54) BRUSH WITH PRESSURE SENSOR

(71) Applicant: Ali Ebrahimi Afrouzi, San Diego, CA (US)

(72) Inventor: Ali Ebrahimi Afrouzi, San Diego, CA (US)

( * ) Notice: Subject to any disclaimer, the term of this patent is extended or adjusted under 35 U.S.C. 154(b) by 37 days.

(21) Appl. No.: 16/794,074

(22) Filed: Feb. 18, 2020

Related U.S. Application Data

(63) Continuation of application No. 15/791,788, filed on Oct. 24, 2017, now Pat. No. 10,602,899.

(60) Provisional application No. 62/404,478, filed on Oct. 5, 2016.

(51) Int. Cl.

| | |
|---|---|
| ***A47L 9/28*** | (2006.01) |
| ***A46B 15/00*** | (2006.01) |
| ***A46B 13/00*** | (2006.01) |
| ***A47L 9/04*** | (2006.01) |
| ***B08B 1/04*** | (2006.01) |
| ***A47L 11/40*** | (2006.01) |
| ***B08B 1/00*** | (2006.01) |

(52) U.S. Cl.
CPC ..... *A47L 9/2847* (2013.01); *A46B 13/001* (2013.01); *A46B 15/0002* (2013.01); *A46B 15/0012* (2013.01); *A47L 9/0477* (2013.01); *A47L 11/4041* (2013.01); *B08B 1/002* (2013.01); *B08B 1/04* (2013.01); *A47L 2201/00* (2013.01); *A47L 2201/04* (2013.01); *A47L 2201/06* (2013.01)

(58) Field of Classification Search
CPC . A46B 13/02; A46B 15/0002; A46B 15/0004; A46B 15/0038; A46B 15/0044; A47L 9/0411; A47L 9/0477; A47L 9/28; A47L 9/2889; A47L 9/2847; A47L 9/2852; A47L 11/19; A47L 11/24; A47L 11/4002; A47L 11/4008; A47L 11/4011; A47L 11/4041; A47L 2201/00; A47L 2201/04; A47L 2201/06
USPC ..... 15/179, 21.1, 50.3, 52.1, 82, 319, 339, 15/340.3, 366, 383
See application file for complete search history.

(56) References Cited

U.S. PATENT DOCUMENTS 4,163,999 A * 8/1979 Eaton ..... H02H 7/093 15/319
4,207,642 A 6/1980 Arato
4,245,370 A * 1/1981 Baker ..... A47L 9/2805 15/319
4,328,522 A * 5/1982 Tryan ..... A47L 9/2805 361/33
4,370,690 A * 1/1983 Baker ..... A47L 9/2842 361/23
4,398,231 A * 8/1983 Currence ..... H02H 7/093 15/319

(Continued)

*Primary Examiner* — Mark Spisich

(57) ABSTRACT

A method for detecting entanglement of an object with a brush of a surface cleaning device includes collecting sensor readings indicative of an operational status of the brush of the surface cleaning device using at least one sensor, detecting entanglement of an object with the brush when a magnitude of the sensor readings exceeds a predetermined threshold for a predetermined amount of time using a motor controller of the brush, notifying a processor of the surface cleaning device of the detected entanglement using the motor controller, and actuating an action in response to the detected entanglement using the processor.

10 Claims, 5 Drawing Sheets

(56) References Cited

U.S. PATENT DOCUMENTS

| | | | | |
|---|---|---|---|---|
| 4,637,092 | A * | 1/1987 | Hayashi | A47L 9/2842 15/319 |
| 5,023,973 | A * | 6/1991 | Tsuchida | A47L 9/2857 15/319 |
| 5,592,710 | A | 1/1997 | Wanner | |
| 5,940,927 | A | 8/1999 | Haegermarck | |
| 6,605,156 | B1 | 8/2003 | Clark | |
| 7,237,298 | B2 * | 7/2007 | Reindle | A47L 9/2821 15/319 |
| 7,599,758 | B2 | 10/2009 | Reindle | |
| 8,141,202 | B2 * | 3/2012 | Hawkins | A47L 9/0494 15/352 |
| 8,600,553 | B2 | 12/2013 | Svendsen | |
| 9,457,471 | B2 | 10/2016 | Schnittman | |
| 2005/0278888 | A1 | 12/2005 | Reindle | |
| 2006/0020369 | A1 * | 1/2006 | Taylor | A47L 9/2852 700/245 |
| 2008/0184518 | A1 * | 8/2008 | Taylor | A47L 9/009 15/319 |
| 2010/0313910 | A1 | 12/2010 | Lee | |
| 2017/0080570 | A1 | 3/2017 | Schnittman | |

* cited by examiner

BRUSH WITH PRESSURE SENSOR

CROSS-REFERENCE TO RELATED APPLICATIONS

This application is a Continuation of U.S. Non-Provisional patent application Ser. No. 15/791,788, filed Oct. 24, 2017, now U.S. Pat. No. 10,602,899, which claims the benefit of U.S. Provisional Patent Application No. 62/404,478, filed Oct. 5, 2016, each of which is hereby incorporated by reference.

FIELD OF THE DISCLOSURE

The disclosure relates to brushes for cleaning surfaces, and more particularly, to robotic vacuum cleaner brushes.

BACKGROUND

During operation robotic vacuum cleaners may encounter obstructions on the working surface which can become entangled in the robotic vacuum brush. These occurrences can keep robotic vacuum cleaners from completing their task and may cause damage to the device if not immediately detected. In some cases, the amount of current drawn by a brush motor has been used to detect entanglement with an obstruction as the current drawn to rotate the brush increases when entanglement occurs. Once entanglement is detected the brush may be programmed to stop and reverse direction until the current is below a certain threshold, at which time the robotic device may resume operation. In some instances, an increase in the current drawn by the brush motor may occur for reasons other than an entanglement with an obstruction, resulting in false detection of a brush entanglement. For example, when operating on a thick pile carpet the current drawn by the brush motor may increase because more power is required to rotate the brush through thick pile carpet. This may trigger the brush motor to stop and the brush to operate in the reverse direction when not needed.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Some embodiments provide a surface cleaning device, including: a chassis; a set of wheels coupled to the chassis; at least one brush; a controller for controlling a motor of the at least one brush; at least one sensor; a processor; memory storing instructions that when executed by the processor effectuates operations including: collecting, with the at least one sensor, sensor readings indicative of an operational status of the at least one brush; detecting, with the controller, entanglement of an object with the at least one brush when a magnitude of the sensor readings exceeds a predetermined threshold for a predetermined amount of time; notifying, with the controller, the processor of the detected entanglement; and actuating, with the processor, an action in response to the detected entanglement.

Some embodiments include a method for detecting entanglement of an object with a brush of a surface cleaning device, including: collecting, with at least one sensor, sensor readings indicative of an operational status of a brush of a surface cleaning device; detecting, with a motor controller of the brush, entanglement of an object with the brush when a magnitude of the sensor readings exceeds a predetermined threshold for a predetermined amount of time; notifying, with the motor controller, a processor of the surface cleaning device of the detected entanglement; and actuating, with the processor, an action in response to the detected entanglement.

BRIEF DESCRIPTION OF DRAWINGS

Non-limiting and non-exhaustive features of the present invention are described with reference to the following figures, wherein like reference numerals refer to like parts throughout the various figures.

DETAILED DESCRIPTION OF SOME EMBODIMENTS

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details.

As understood herein, the term "robot" or "robotic device" may be defined generally to include one or more autonomous devices having communication, mobility, and/or processing elements. For example, a robot or robotic device may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., and one or more clock or synchronizing devices.

Some embodiments provide a rotatable brush with a protection mechanism. In some embodiments, the brush comprises a shaft with a plurality of bristles protruding radially therefrom. In some embodiments, the protection mechanism comprises a pressure sensor comprising a projecting blade extending along the length of the shaft connected thereto by a flexible member attached to a tactile sensor. When pressure around the brush reaches a predetermined threshold, the projecting blade will force the connecting flexible member to compress and actuate the tactile sensor. The tactile sensor is electronically coupled with a processor or controller so that when the tactile sensor is actuated, a variety of responses are programmed to occur. Responses may include any of: halting rotation of the brush, reversing rotation of the brush, temporarily reversing rotation of the brush, slowing rotation of the brush, pausing rotation of the brush, turning off a device containing the brush, activating an alert on a device containing the brush, and altering the operation of a device containing the brush in any other way. In some embodiments, responses are triggered only after the sensor has been actuated for a predetermined length of time.

It will be obvious to persons skilled in the art that such a brush can be used in various types of surface cleaning devices, such as, but not limited to, robotic vacuum cleaners, upright vacuum cleaners, or other surface cleaning devices.

A projecting bar, projecting tabs or other projecting members may be employed instead of a projecting blade without departing from the scope of the invention so long as the form of the projecting member allows it to transfer pressure caused by an entanglement around the brush to the tactile sensor.

Various types of mechanical or electronic pressure sensors or pressure-actuated switches may be employed as the tactile sensor.

Figure 1A:
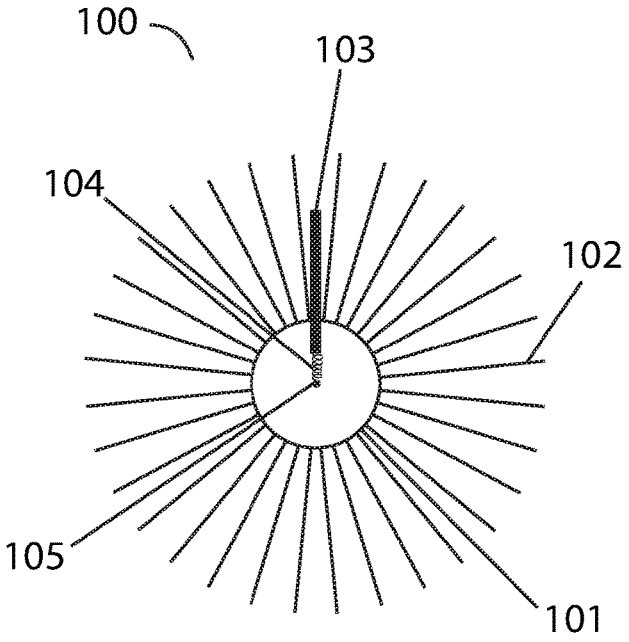
FIG. 1A illustrates a cross sectional view of a robotic vacuum brush with a pressure sensor, according to some embodiments.

FIG. 1A illustrates a cross sectional side view of brush 100. Brush 100 is comprised of shaft 101 and plurality of bristles 102 projecting radially outward from shaft 101. Projecting blade 103 is disposed along the length of the shaft and projects through an aperture in the shaft (not shown). Projecting blade 103 is attached to tactile sensor 105 via one or more flexible members 104. In some embodiments, the one or more flexible members 104 are comprised of springs. Projecting blade 103 is positioned such that any force imposed on it is transferred to the one or more flexible members 104, which, when compressed, actuates tactile sensor 105.

Figure 1B:
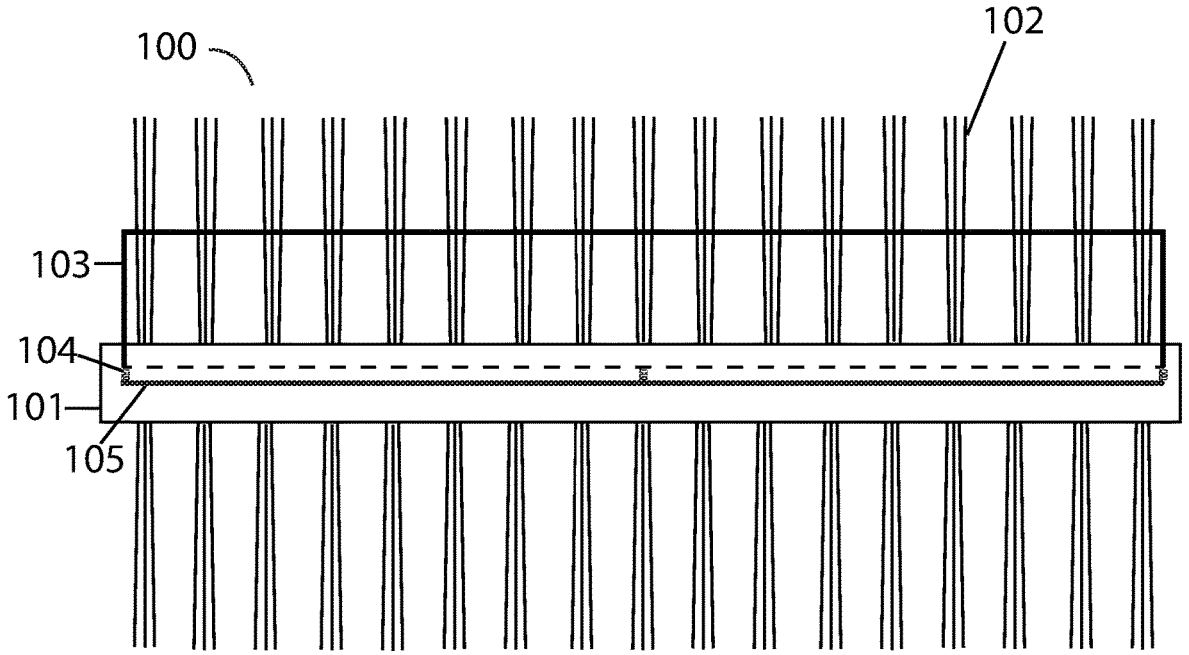
FIG. 1B illustrates a front view of a robotic vacuum brush with a pressure sensor, according to some embodiments.

FIG. 1B illustrates a front view of brush 100. Brush 100 is comprised of shaft 101 and bristles 102 projecting radially outward from shaft 101. Projecting blade 103 is disposed along the length of shaft 101 and projects through an aperture (not shown). Projecting blade 103 is attached to tactile sensor 105 via one or more flexible members 104.

Figure 2A:
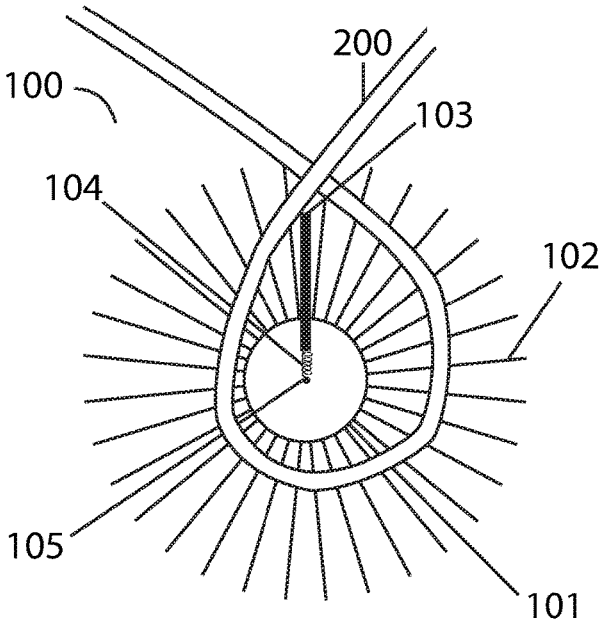
FIG. 2A illustrates a cross sectional view of a robotic vacuum brush with a pressure sensor becoming entangled with a cord, according to some embodiments.
Figure 2B:
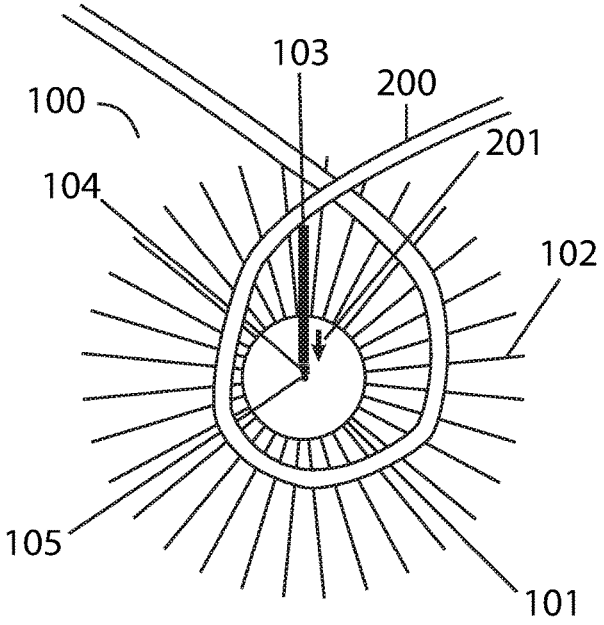
FIG. 2B illustrates a cross sectional view of a robotic vacuum brush with a pressure sensor actuated by an electrical cord entangling the brush, according to some embodiments.

FIG. 2A illustrates a side view of brush 100 with projecting blade 103 entangled with electrical cord 200. Such occurrences may take place when, for example, a robotic vacuum drives over an electrical cord during operation. In this instance, electrical cord 200 has not placed enough pressure on projecting blade 103 to cause flexible member 104 to compress and actuate tactile sensor 105. FIG. 2B illustrates a side view of brush 100 with projecting blade 103 actuated due to entanglement with electrical cord 200. Electrical cord 200 has become more tightly wound around brush 100, which can occur as a result of continued rotation of the brush after entanglement. Electrical cord 200 eventually puts enough pressure on projecting blade 103 to force it inward in direction 201, causing projecting blade 103 to compress flexible member 104 and actuate tactile sensor 105. Any of a variety of responses may be programmed to occur after the tactile sensor has been actuated, such as: halting rotation of the brush, reversing the rotation of the brush, temporarily reversing rotation of the brush, slowing rotation of the brush, pausing rotation of the brush, turning off a device containing the brush, activating an alert on a device containing the brush, sending or displaying a notification to a user, or altering movement or operation of the device containing the brush in any other way.

It will be obvious to one skilled in the art that the projecting blade does not need to be made of a single member and the same result may be accomplished with multiple members connected to each other or multiple members each being paired with a corresponding tactile sensor. The single projecting blade may be replaced by a plurality of shorter blades, in totality extending along the length of the shaft.

Figure 3:
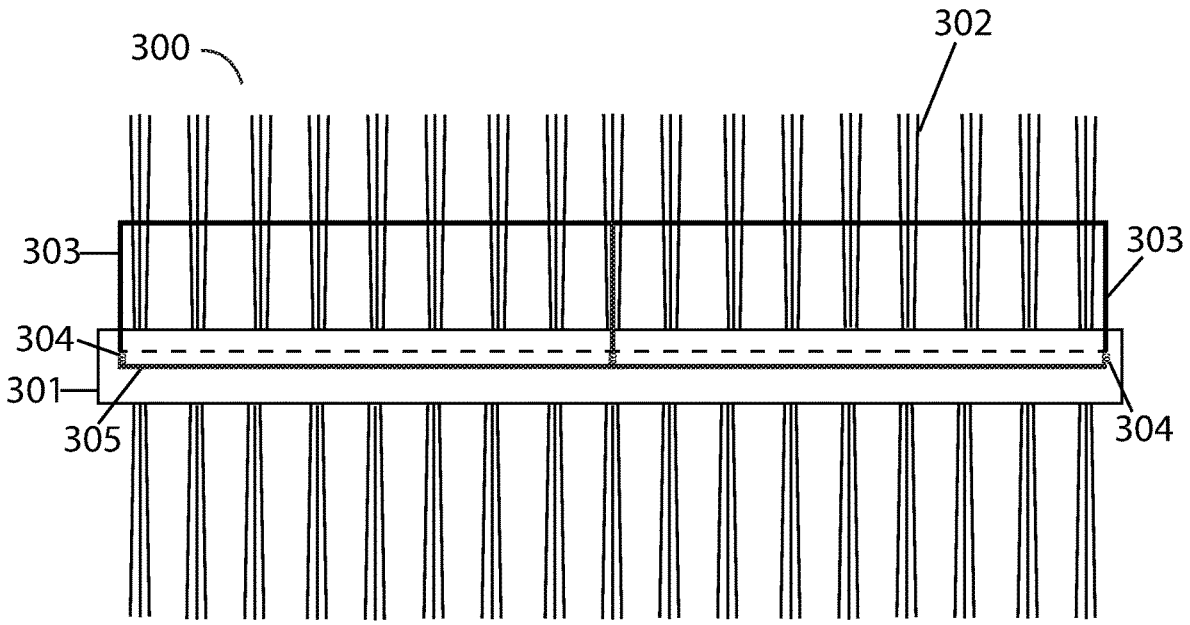
FIG. 3 illustrates an example of a robotic vacuum brush, according to some embodiments.
Figure 4:
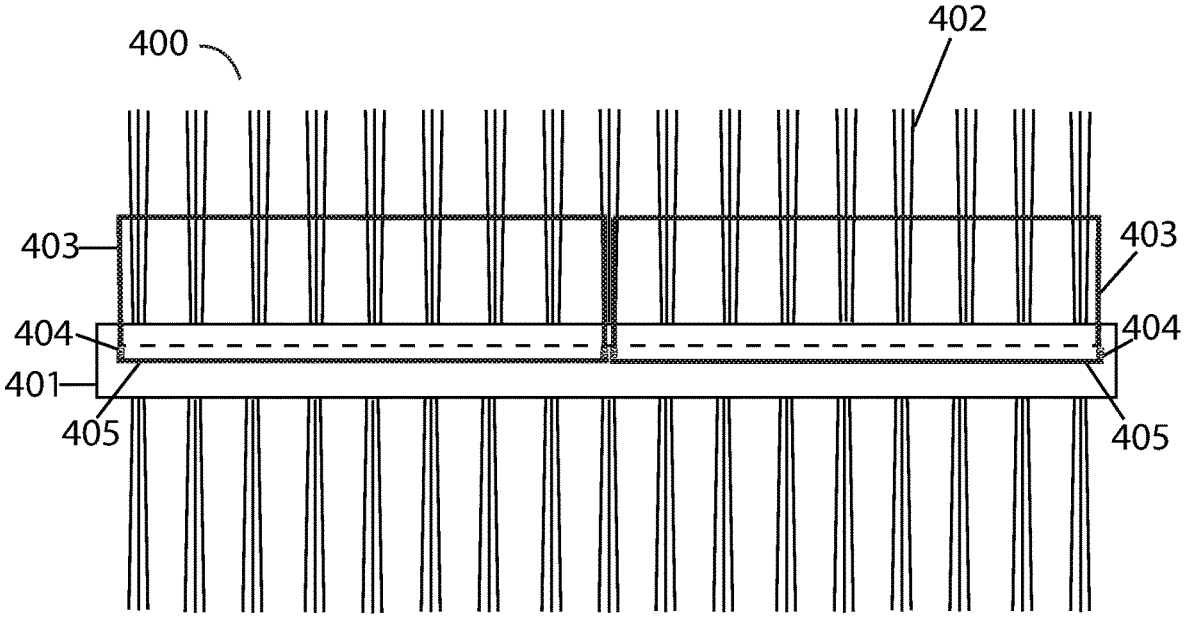
FIG. 4 illustrates an example of a robotic vacuum brush, according to some embodiments.

FIG. 3 illustrates a front view of brush 300. Brush 300 is comprised of shaft 301 and bristles 302 projecting radially outward from shaft 301. Projecting blades 303 are disposed along the length of shaft 301 and project through apertures (not shown). Projecting blades 303 are attached to tactile sensor 305 via one or more springs 304. FIG. 4 illustrates a front view of brush 400. Brush 400 is comprised of shaft 401 and bristles 402 projecting radially outward from shaft 401. Projecting blades 403 are disposed along the length of shaft 401 and project through apertures (not shown). Projecting blades 403 are each attached to tactile sensor 405 via one or more springs 404.

Figure 5:
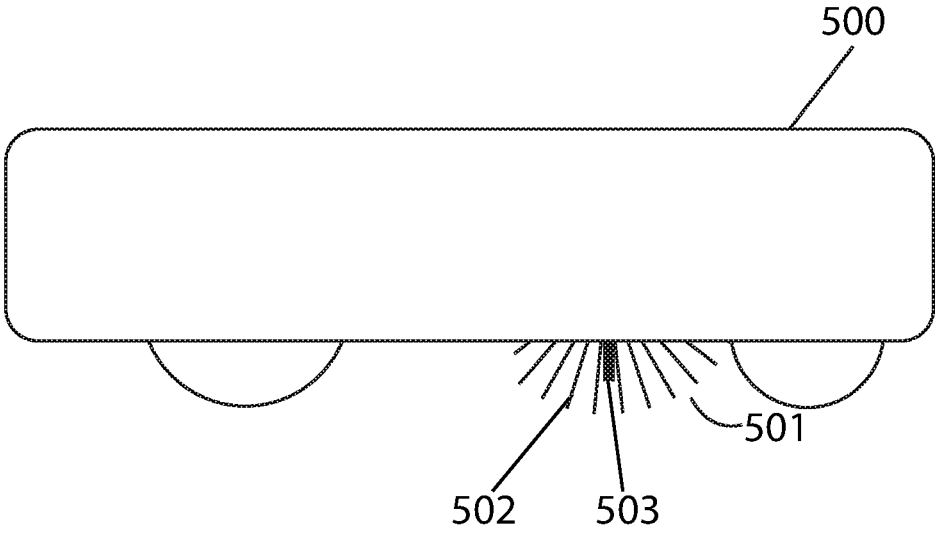
FIG. 5 illustrates an example of a robotic vacuum with a robotic vacuum brush, according to some embodiments.

FIG. 5 illustrates a side view of a robotic vacuum 500 with brush 501. Brush 501 may be a brush as described above in FIGS. 1A, 1B, 3, and 4 with bristles 502 and projecting blade 503.

The foregoing descriptions of specific embodiments of the invention have been presented for purposes of illustration and description. They are not intended to be exhaustive or to limit the invention to the precise forms disclosed. Obviously, many modifications and variations are possible in light of the above teaching. The embodiments were chosen and described in order to explain the principles and the application of the invention, thereby enabling others skilled in the art to utilize the invention in its various embodiments and modifications according to the particular purpose contemplated. The scope of the invention is intended to be defined by the claims appended hereto and their equivalents.

The invention claimed is:

1. A surface cleaning device, comprising:
- a chassis;
- a set of wheels coupled to the chassis;
- at least one brush;
- a controller for controlling a motor of the at least one brush;
- at least one sensor comprising at least one projecting member positioned on a shaft of the at least one brush;
- a processor;
- memory storing instructions that when executed by the processor effectuates operations comprising:
  - collecting, with the at least one sensor, sensor readings indicative of an operational status of the at least one brush;
  - detecting, with the controller, entanglement of an object with the at least one brush when a magnitude of the sensor readings exceeds a predetermined threshold for a predetermined amount of time;
  - notifying, with the controller, the processor of the detected entanglement; and
  - actuating, with the processor, an action in response to the detected entanglement.

2. The surface cleaning device of claim 1, wherein the action comprises at least one of: turning off the surface cleaning device, altering the movement of the surface cleaning device, altering the operation of the surface cleaning device, displaying a notification to a user, and activating an alert on the surface cleaning device.

3. The surface cleaning device of claim 1, wherein the action comprises at least one of: halting rotation of the at least one brush, reversing the rotation of the at least one brush, temporarily reversing the rotation of the at least one brush, slowing rotation of the at least one brush, pausing rotation of the at least one brush, and turning off the at least one brush.

4. The surface cleaning device of claim 1, wherein the action comprises sending a notification to a user.

5. The surface cleaning device of claim 1, wherein the at least one sensor is electronically coupled to the controller.

6. The surface cleaning device of claim 1, wherein the at least one sensor further comprises at least one of: a mechanical sensor, an electronic sensor, and a switch.

7. The surface cleaning device of claim 1, wherein the sensor readings collected by the at least one sensor are indicative of a pressure around the at least one brush.

8. The surface cleaning device of claim 1, wherein the at least one projecting member is connected at a proximal side to at least one tactile sensor that is actuated when the pressure on the at least one projecting member exceeds a predetermined threshold.

9. The surface cleaning device of claim 8, wherein the at least one projecting member is connected to the at least one tactile sensor by at least one a-flexible member.

10. The surface cleaning device of claim 9, wherein the at least one flexible member comprises a spring.

* * * * *